US005567148A

United States Patent [19]

Krueger et al.

[11] Patent Number: 5,567,148

[45] Date of Patent: Oct. 22, 1996

[54] GASEOUS FUEL BURNER ASSEMBLY AND METHOD OF CONNECTING SAME

[75] Inventors: Donald M. Krueger, Westchester; David J. Kwiatek, LaGrange, both of Ill.

[73] Assignee: Eaton Corporation, Cleveland, Ohio

[21] Appl. No.: 359,754

[22] Filed: Dec. 20, 1994

[51] Int. Cl.[6] ..... F23D 14/62

[52] U.S. Cl. ..... 431/354; 126/39 E

[58] Field of Search ..... 431/354; 126/39 E

[56] References Cited

U.S. PATENT DOCUMENTS 4,846,671 7/1989 Kwiatek ..... 431/266 R
4,953,534 9/1990 De Gouville et al. ..... 431/354 X
5,040,970 8/1991 Riehl ..... 431/264
5,160,256 11/1992 Riehl ..... 126/39 BA X
5,316,470 5/1994 Sigler ..... 431/354 X
5,468,143 11/1995 Weber et al. ..... 431/354 X

*Primary Examiner*—Larry Jones
*Attorney, Agent, or Firm*—Roger A. Johnston

[57] ABSTRACT

A fuel gas burner has a supply tube formed with a supply orifice in one end surrounded by aspirator vanes. The burner has a venturi member with a reduced diameter throat region received in the burner inlet. The aspirator vanes frictionally engage the throat region of the venturi. In one embodiment of the venturi comprises a helically wound wire and in another embodiment an annular member with turbulating surfaces formed downstream of the throat.

12 Claims, 1 Drawing Sheet

GASEOUS FUEL BURNER ASSEMBLY AND METHOD OF CONNECTING SAME

BACKGROUND OF THE INVENTION

The present invention relates to burner assemblies for appliances utilizing gaseous fuel and in particular relates to fuel burner assemblies for domestic cooking appliances. In the manufacture of gas cooking ranges for household use, it is necessary to provide ease of assembly and removal of the individual fuel burners where an array of burners is provided on the top of the range and to reduce the manufacturing cost to a minimum in order that the appliance may be mass produced and remain competitive in the market for household appliances.

Heretofore, in one common arrangement of top fuel burners for domestic ranges, the burner is formed with an inlet which is adapted to be connected to a fuel supply tube in such a manner as to provide an aspirator to entrain a flow of air necessary for the fuel air mixing in order to provide a combustible mixture which can produce flame at the burner outlet ports. In the design and manufacture of gas burner assemblies for cooking appliances, it has been found desirable to locate the air aspirator at the burner inlet in order to enable the use of a smaller diameter tubing for connection to the burner. Where the aspirator has been located remotely from the burner, a larger diameter tube is necessitated for delivering the air/fuel mixture from the aspirator inlet to the burner inlet. In assembling the burners in the rangetop during the manufacture of household ranges employing remote burner aspirators, it has proven difficult to accurately locate and connect the larger diameter tube to the burner and remotely to the fuel supply tube because of the inflexibility of the larger diameter tube.

In household rangetop burner arrangements where the aspirator is located at the burner inlet and the fuel supply tube is connected to a top burner by a threaded fitting it is necessary to accurately align the ends of the supply tubes with the burners in order to make the threaded connections which has proven to be difficult to connect where the supply tubes are situated above an oven and are bent or formed at angles within the range cabinet. Furthermore, it has been difficult to assemble and tighten the threaded connection where access is only provided through a cut-out in the top of the range and where the supply tube enters the burner inlet on the lower portion thereof. In addition, the threaded type connections have proven to be costly and cumbersome in that the diameter of the fitting required for the threaded connection reduces the area around the tube available for aspiration of primary burner air for a given burner inlet diameter. Where the space available for the burner is limited, it has been extremely difficult to design the burner for right angle fuel line attachment and yet provide adequate provision for aspiration of air at the burner inlet.

Accordingly, it has been desired to provide for connecting a fuel supply tube to the burner inlet and forming an aspirator at the connection in a manner that is low in manufacturing cost and which provides a positive connection and one which accommodates relative misalignment of the pre-positioned fuel supply tube where the tube is small enough in diameter to permit some flexing to enable assembly of misaligned parts.

SUMMARY OF THE INVENTION

It is an object of the present invention to provide a gaseous fuel burner having a venturi forming member provided in the inlet thereof with a fuel supply tube having an aspirator formed on the end thereof inserted in the venturi member and retained therein for connecting the fuel supply tube to the burner and providing for aspiration of air for mixing with the fuel discharging into the burner inlet from the supply tube.

It is a further object of the present invention to provide a venturi member in the inlet of a gaseous fuel burner and to provide for insertion of a fuel supply tube having an aspirator formed thereon into the venturi and frictionally engaging the venturi for maintaining the connection of the fuel supply tube and aspirator to the burner inlet.

It is a further object of the present invention to provide for a venturi member in the form of a helically wound member frictionally received in the inlet of the gaseous fuel burner and having a fuel supply tube with an aspirator thereon frictionally engaging the venturi member for maintaining the connection of the fuel supply tube to the burner inlet.

It is a further object of the invention to provide turbulating surfaces in the region downstream of the throat of an aspirator in the inlet of a fuel burner to facilitate mixing of the fuel and air.

The present invention provides a gaseous fuel burner having an inlet communicating with a plurality of flame-generating outlet ports with a venturi member having a reduced diameter throat portion intermediate the ends thereof received in and retained in the inlet. A fuel supply tube having an aspirator structure formed on one end thereof is received in and frictionally engages the venturi member for retaining the aspirator and fuel supply tube in connection with the burner inlet. In one embodiment the venturi member is formed as a helical coil spring and in another embodiment the venturi member is a solid annular member. Preferably turbulating surfaces are provided in the venturi downstream of the throat to facilitate mixing of fuel discharging from the supply tube and aspirated air.

DETAILED DESCRIPTION

Figure 1:
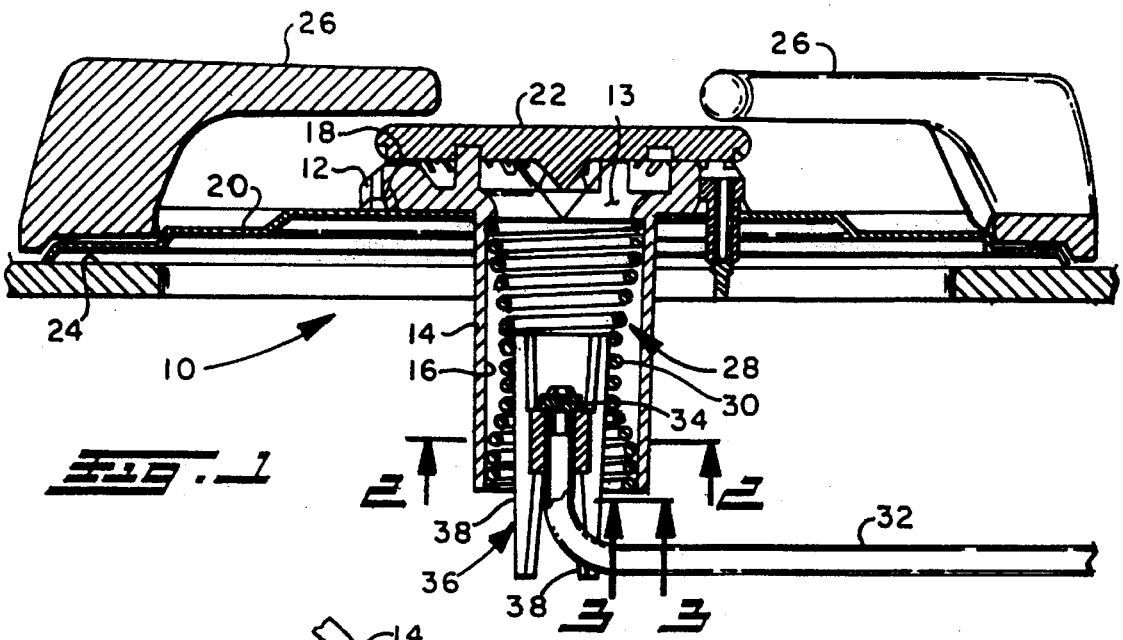
FIG. 1 is a cross-section of the burner assembly of the present invention with the supply tube connected to the burner.

Referring to FIG. 1, a range top burner assembly is indicated generally at 10 and has a hollowed body or manifold 12 which has a generally annular configuration with a reduced diameter inlet portion 14 which has an inlet passage 16 which communicates with a mixing chamber 13 which in turn communicates with a plurality of flame-generating outlet passages or ports 16. In the presently preferred practice a plurality of spaced grooves 18 are formed in the upper end face of the body 12 and a cap 18 is received thereover for closing the grooves 18 into passages.

The burner body 12 is supported on a support plate 20 which is typically provided on the top deck 24 of a range. The reduced diameter portion of the body 14 which has inlet 16 formed therein is received through an aperture or cutout in the support plate 20 and deck 24 and extends downwardly therefrom in a typical cooking appliance application where the top burners are located over an oven.

In the arrangement of the burner assembly of FIG. 1 in a typical appliance, a cooking rack or support structure 26 is provided for supporting receptacles above the burner for heating or cooking of desired liquids or foodstuffs. A venturi forming member indicated generally at 28 is received in the inlet 16 and is preferably frictionally engaged therein. In the embodiment of FIG. 1 the venturi 28 has a converging inlet section, a throat region and a diverging outlet section and comprises a helically wound wire coil having reduced diameter coils 30 intermediate the ends thereof for forming the throat region of the venturi.

Figure 2:
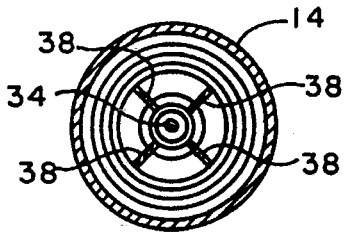
FIG. 2 is a cross-section taken along section indicating lines 2—2 of FIG. 1.

A fuel supply tube 32 has one end thereof formed at generally right angles to the main portion of the tube which is typically disposed along the top of the oven portion of the range and has a fuel supply orifice 34 formed thereon. The end of the tube 32 adjacent the orifice 34 has provided thereon aspirator structure indicated generally at 36, which in the presently preferred embodiment comprises a plurality of vanes or flutes 38 arranged in a circumferentially spaced arrangement as shown in FIG. 2 and extending along the direction of the inlet passage 16. In the presently preferred practice, the vanes and the orifice 34 are received in the venturi member and the outer edges of the vanes frictionally engage the inner surface thereof preferably in the region of the throat coils 30, it being understood that the vanes may also engage the interior of the lower end coils of the venturi member 28.

Figure 3:
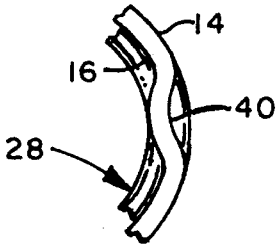
FIG. 3 is a portion of a cross-section taken along taken along section indicating lines 3—3 of FIG. 1.

Referring to FIG. 3, the venturi member is retained in the inlet 16 by localized deformation of the wall of the reduced diameter portion 14 of the burner as denoted by reference numeral 40 in FIG. 3. It will be understood that the aspirator structure comprising the vanes 38 in the embodiment of FIG. 1 may be attached to the supply tube 32 by any convenient expedient, as for example, weldment such as brazing. Referring to FIG. 1, the undulating surface of the venturi 28 in the flow direction as formed by the wire coil, particularly in the diverging portion downstream of the throat region 30 creates turbulating surfaces which facilitate the mixing of the fuel and air.

Figure 4:
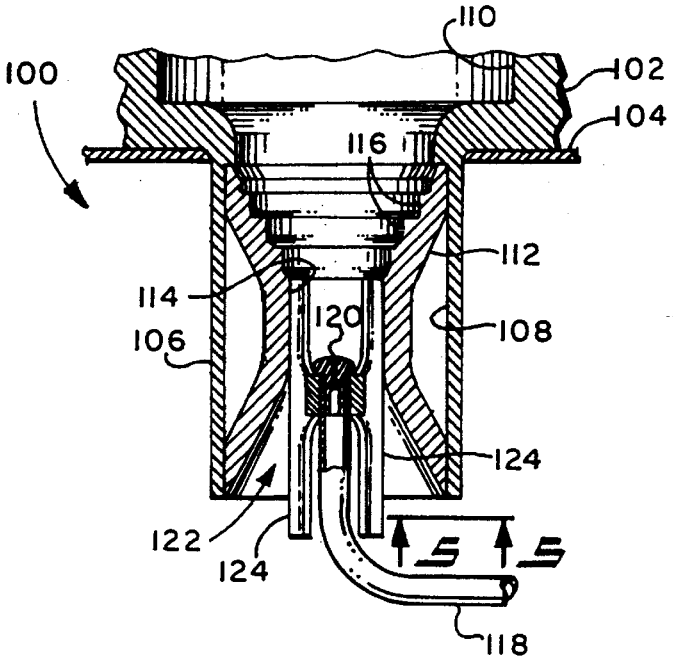
FIG. 4 is a portion of a view similar to FIG. 1 showing an alternate embodiment of the invention; and, FIG. 5 is a portion of a section view taken along section indicating lines 5—5 of FIG. 4.

Referring to FIG. 4, another embodiment of the invention indicated generally at 100 has a burner body 102 with a reduced diameter portion 106 received through an aperture formed in a support plate 104 which is a portion of a range (not shown). Reduced diameter portion 106 of the body is formed with an inlet 108 which communicates with a passage or mixing chamber 110 for supplying a plurality of flame-generating outlets (not shown in FIG. 4). An annular one piece solid venturi member 112 is received in inlet passage 108 preferably in frictional or press fitting arrangement. Venturi member 112 has a throat region 114 of reduced diameter formed intermediate the ends thereof. Turbulating surfaces in the form of annular grooves 116 are provided in the diverging region downstream of the throat 114 to facilitate mixing of the fuel and air.

A supply tube 118 has the end thereof formed at generally right angles to the main inlet portion of the tube with a discharge orifice 120 formed in the end of the tube.

An aspirator indicated generally at 122 is provided on the end of the tube surrounding orifice 120. In the present practice of the invention the aspirator comprises a plurality of circumferentially spaced vanes or flutes 124 which are received in the throat region 114 of the venturi. In the embodiment of FIG. 4, the vanes 124 preferably frictionally engage the throat 114 for retaining the supply tube and aspirator in place in the venturi member 112.

Figure 5:
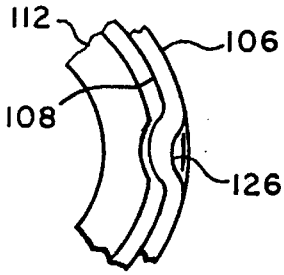

Referring to FIG. 5 the rim or periphery of the burner inlet 106 has a portion thereof deformed or staked as denoted by reference numeral 126 over the end of the venturi member for retaining the venturi 112 in the inlet 108.

The present invention thus provides for a simple and low cost technique of providing an aspirator at the inlet of a fuel gas burner and for retaining the fuel supply tube in the burner inlet without the need of any threaded fasteners.

Although the present invention has been described hereinabove with respect to the illustrated embodiments, it will be understood that the invention is capable of modification and variation and is limited only by the following claims.

We claim:

1. A gaseous fuel burner assembly comprising:

(a) a burner manifold or body having an inlet passage and a plurality of flame-generating outlets communicating with said inlet passage;

(b) a venturi member defining a converging inlet and diverging outlet with a throat region therebetween said member disposed in said body inlet passage;

(c) a gaseous fuel supply tube including an aspirator at one end thereof, said aspirator inserted in and frictionally engaging said venturi member for retaining said tube connected to said manifold; wherein said venturi member diverging outlet section includes turbulating surfaces.

2. The assembly defined in claim 1, wherein said venturi member comprises a helical coil having a converging-diverging configuration with the smallest diameter coils thereof defining said venturi throat region and the outer periphery of the larger diameter coils of said spring frictionally engaging said manifold inlet passage, wherein the coils of said spring form turbulating surfaces in the diverging portion of said venturi member.

3. A method of connecting a fuel gas supply tube to a fuel gas burner having an inlet and a plurality of flame-generating outlets comprising:

(a) forming an annular venturi member having a converging inlet end and a diverging outlet end and a throat region of significantly reduced diameter intermediate said ends; and, forming turbulating surfaces in the diverging outlet;

(b) inserting the outlet end of said venturi member in the inlet of said burner inlet;

(c) providing an aspirator on one end of said supply tube;

(d) inserting said aspirator in said venturi and frictionally engaging the inner periphery of said venturi;

(e) retaining said venturi member in said burner inlet.

4. The method defined in claim 3, wherein said step of forming a venturi member includes helically winding a coil of wire.

5. The method defined in claim 3, wherein said step of forming said venturi member includes forming turbulating surfaces downstream of the throat.

6. The method defined in claim 3, wherein said step of forming said venturi member includes forming annular turbulating surfaces downstream of the throat.

7. A fuel gas burner assembly comprising:

(a) A burner manifold having an inlet communicating with a plurality of individual flame-generating outlet ports;

(b) a venturi member comprising a coil spring having a throat with a converging-diverging nozzle, said nozzle having turbulating surfaces on the diverging portion of the nozzle with said venturi engaged in said manifold inlet with the ends of said spring press fitted in said manifold inlet;

(c) a fuel supply tube having a plurality of vanes disposed about one end thereof in spaced arrangement, said vanes frictionally engaging said venturi throat for forming aspirator passages therebetween and retaining said tube connected to said inlet.

8. The assembly defined in claim 7, wherein said venturi member comprises a coil spring and said turbulating surfaces comprises the interstices between adjacent coils.

9. The assembly defined in claim 7, wherein said venturi member comprises a coil spring with the end coils thereof press fitted in said manifold inlet.

10. A fuel gas burner assembly comprising:

(a) a burner having an inlet communicating with an array of flame-generating outlet ports;

(b) an annular venturi member having a converging inlet end, a throat and a diverging outlet end with turbulating surfaces formed thereabout, said venturi member received in said burner inlet;

(c) a gaseous fuel supply tube having a plurality of flutes or spacers disposed about the periphery of one end thereof in spaced arrangement, said flutes frictionally engaging said venturi throat for retaining said tube and in said inlet thereby forming an aspirator.

11. The assembly defined in claim 10, wherein said venturi member comprises a helically wound wire.

12. The assembly defined in claim 10, wherein said venturi member comprises a helically coiled member with the throat formed by a reduced diameter coil intermediate the end coils.

* * * * *